US011306466B1

(12) United States Patent
Zwirn

(10) Patent No.: US 11,306,466 B1
(45) Date of Patent: Apr. 19, 2022

(54) COUNTER PROTECTOR

(71) Applicant: Bradley Zwirn, Kenosha, WI (US)

(72) Inventor: Bradley Zwirn, Kenosha, WI (US)

( * ) Notice: Subject to any disclaimer, the term of this patent is extended or adjusted under 35 U.S.C. 154(b) by 61 days.

(21) Appl. No.: 17/061,790

(22) Filed: Oct. 2, 2020

(51) Int. Cl.
*E03C 1/186* (2019.01)
*A47K 1/06* (2006.01)

(52) U.S. Cl.
CPC ..... *E03C 1/186* (2013.01); *A47K 1/06* (2013.01)

(58) Field of Classification Search
CPC ..... A47K 1/06; E03C 1/186
USPC ..... 4/655–657
See application file for complete search history.

(56) References Cited

U.S. PATENT DOCUMENTS

| | | | | |
|---|---|---|---|---|
| 2,817,851 | A | 12/1957 | Barnwell | |
| 5,815,856 | A | 10/1998 | Dore | |
| 6,223,362 | B1 | 5/2001 | Liang | |
| 6,258,455 | B1 * | 7/2001 | Clarke | A61L 2/16 428/395 |
| 9,015,877 | B2 | 4/2015 | Litwhiler | |
| 9,179,804 | B2 * | 11/2015 | May | E03C 1/181 |
| 9,867,506 | B2 | 1/2018 | Phillips | |
| 10,301,802 | B1 * | 5/2019 | Pinkerton | E03C 1/186 |

* cited by examiner

*Primary Examiner* — Christine J Skubinna

(57) ABSTRACT

An illustrated view of a countertop protective device for preventing water from a faucet from damaging or marring a countertop is presented. The countertop protective device is useful for keeping the countertop clean. The countertop protective device is useful for preventing dirt and crud from gathering on a countertop. The countertop protective device is useful for protecting grout and/or caulk. The countertop protective device is good looking, while allowing a person to avoid constant wiping of the countertop.

14 Claims, 3 Drawing Sheets

COUNTER PROTECTOR

FIELD OF THE INVENTION

This invention relates to countertops. More particularly, it relates to water protection devices for countertops.

BACKGROUND

A countertop (also countertop, counter, benchtop) is a horizontal work surface in kitchens or other food preparation areas, bathrooms or lavatories, and workrooms in general. It is frequently installed upon and supported by cabinets. The surface is positioned at an ergonomic height for the user and the particular task for which it is designed. A countertop may be constructed of various materials with different attributes of functionality, durability, and aesthetics. The countertop may have built-in appliances, or accessory items relative to the intended application.

A sink, also known by other names including sinker, washbowl, hand basin, and wash basin, is a bowl-shaped plumbing fixture used for washing hands, dishwashing, and other purposes. Sinks have taps (faucets) that supply hot and cold water and may include a spray feature to be used for faster rinsing. They also include a drain to remove used water; this drain may itself include a strainer and/or shut-off device and an overflow-prevention device. Sinks may also have an integrated soap dispenser or a freestanding dispenser. Many sinks, especially in kitchens, are installed adjacent to or inside a countertop.

A faucet is a valve controlling the release of a liquid or gas. The faucet is commonly used in kitchens with a sink and in bathrooms and other rooms of a house or business.

Often times faucets leak or water will fall down to the countertop. This can cause the countertop to have buildup or can make the countertop unseemly. The homeowner then must clean the countertop to remove the water spillage to prevent markings or dirt collection.

Accordingly, and in light of the foregoing, there is a need for a device to contain any water leaking or seeping from a faucet before it puddles or runs onto the countertop.

DETAILED DESCRIPTION

Figure 1:
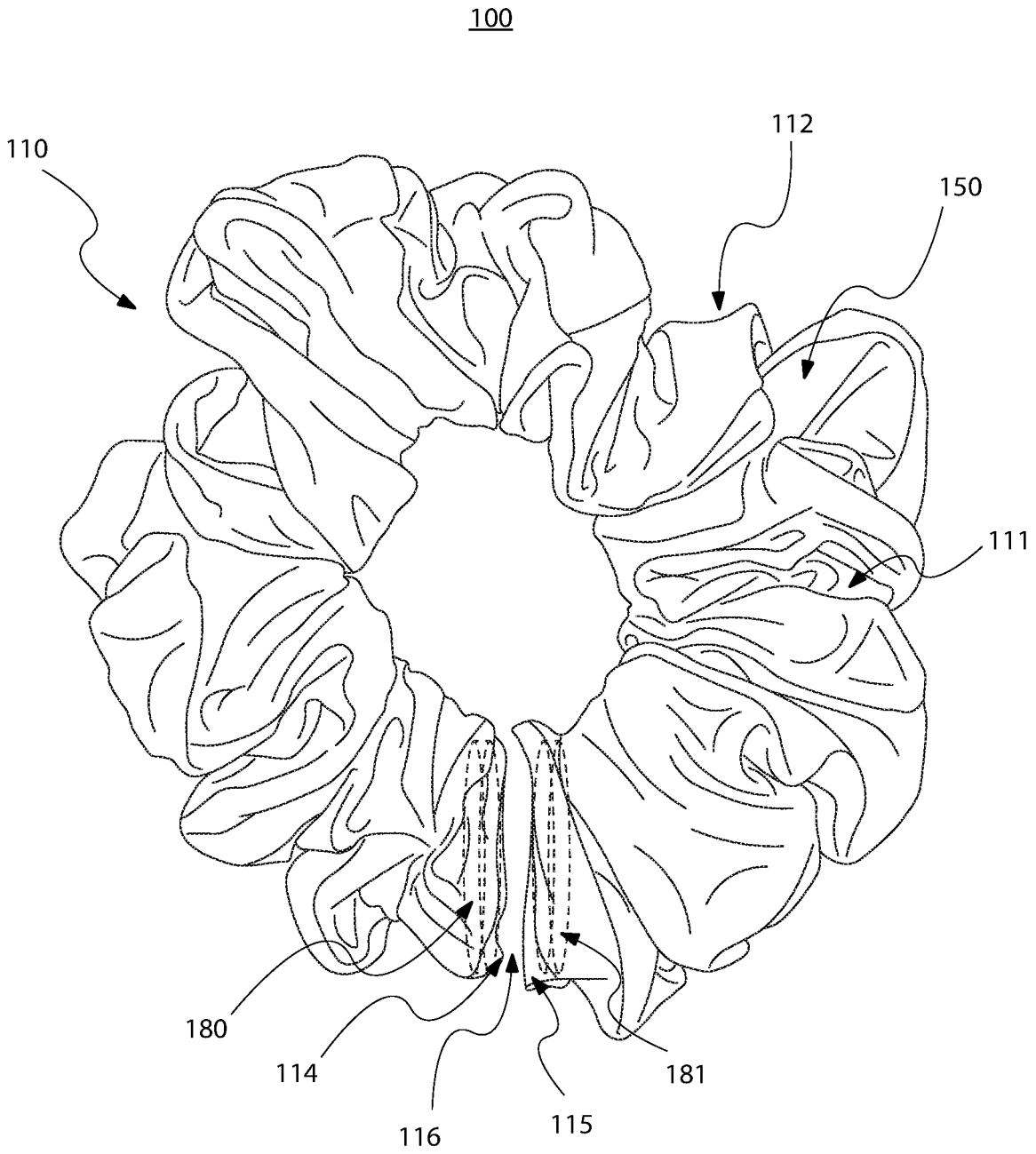
FIG. 1 is an illustrated view of a countertop protective device.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of a countertop protective device 100 for preventing water from a faucet from damaging or marring a countertop is presented. The countertop protective device 100 is useful for keeping the countertop clean. The countertop protective device 100 is useful for preventing dirt and crud from gathering on a countertop. The countertop protective device 100 is useful for protecting grout and/or caulk. The countertop protective device 100 is good looking, while allowing a person to avoid constant wiping of the countertop.

The countertop protective device 100 has an outer covering 110, an inner material 150 and a plurality of magnets 180, 181. The countertop protective device 100 is preferably a round shape, however other shapes are hereby contemplated, including, but not limited to, square, oval, rectangular, etc. The countertop protective device 100 is preferably extendable and retractable, thereby allowing a tight fit around the faucet. The outer covering 110 is preferably made of a porous material, such as a cloth material, however other materials are hereby contemplated, including, but not limited to, mesh, nylon, etc. The outer covering 110 is configured to allow the passing of any water from the faucet to the inner material.

The outer covering 110 has an inside 111 and an outside 112. The inner material 150 is removably coupled to the inside 111 of the outer covering 110. Furthermore, the plurality of magnets 180, 181 are coupled to the inside 111 of the outer covering 110 preferably substantially near the first end 114 and the second end 115 of the outer covering 110. The magnets 180, 181 provide a secure and removable coupling when the first end 114 of the outer covering is in substantial contact with the second end 115 of the outer covering 110. The separation of the first end 114 and the second end 115 provides an opening 116 to fit around the faucet.

The magnets 180, 181 are preferably neodymium iron boron (NdFeB) magnets, however other types of magnets are hereby contemplated, including, but not limited to, samarium cobalt (SmCo), alnico, ceramic or ferrite magnets, etc.

The inner material 150 is useful for absorbing any water which may penetrate the outer covering 110, thereby not allowing the water to become present on the countertop. The inner material 150 is preferably made of a washable material, however the inner material 150 may be made of a non-washable material. The inner material 150 is preferably made of an absorbent material, such as a sponge material, however other materials are hereby contemplated, including, but not limited to, cotton, cloth, etc.

Figure 2A:
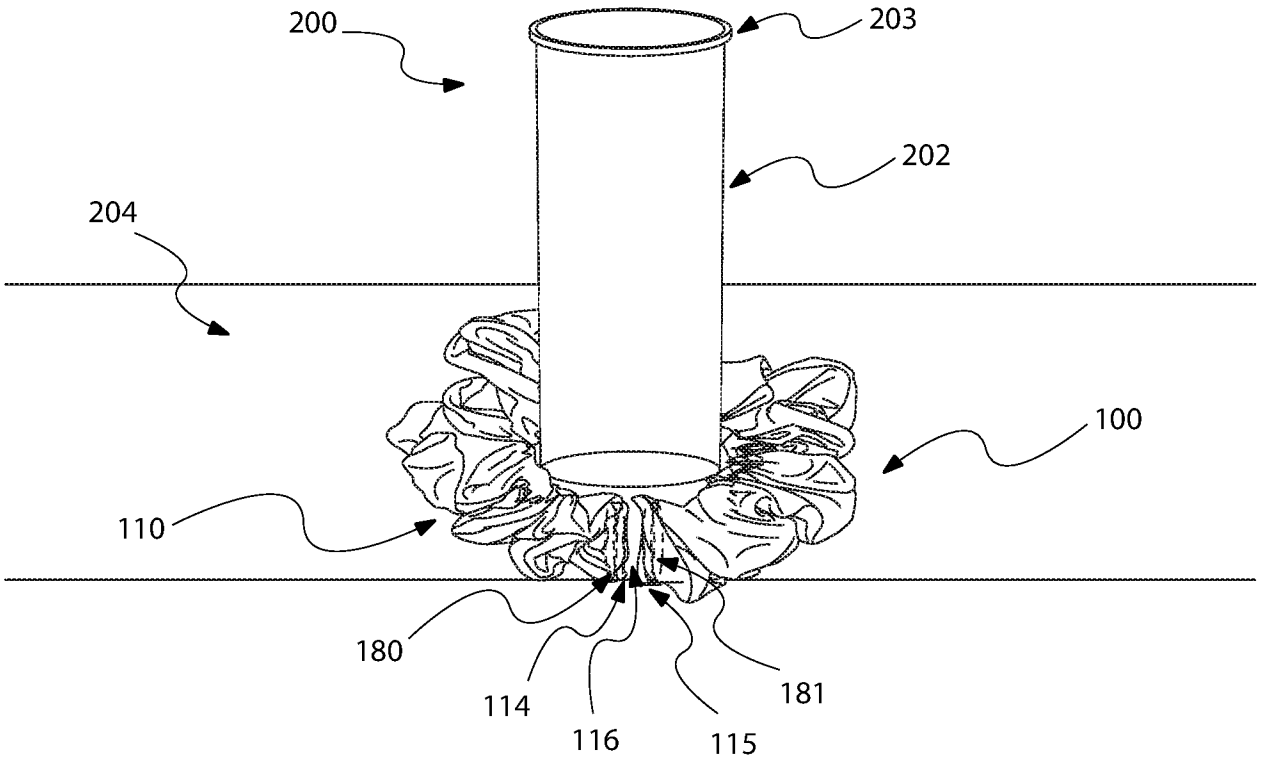
FIG. 2A and FIG. 2B are illustrated views of the use of the countertop protective device shown in FIG. 1.
Figure 2B:
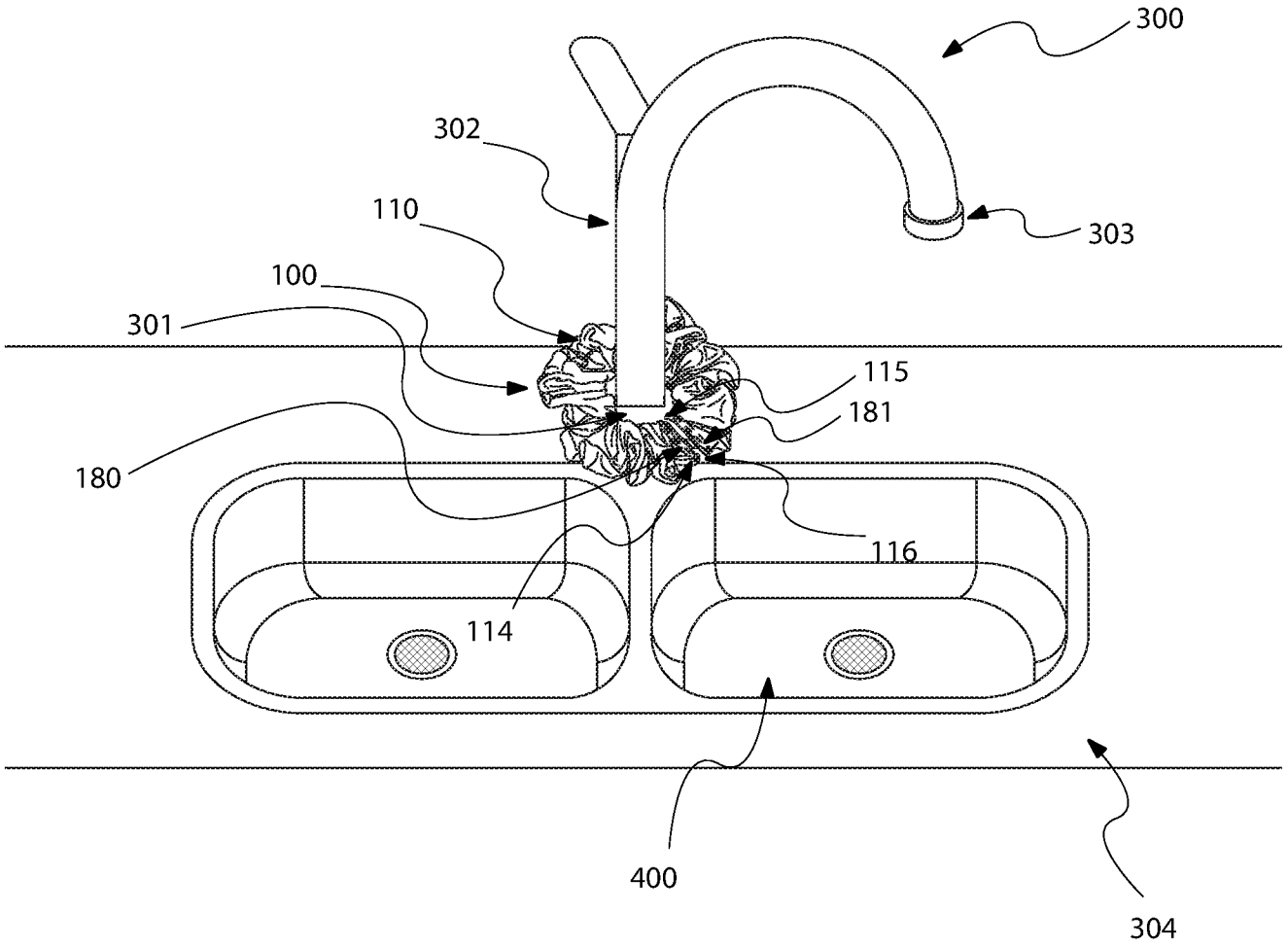

Moving now to FIG. 2A and FIG. 2B, illustrated uses of the countertop protective device 100 shown with a freestanding dispenser 200, in FIG. 2A, and with a kitchen faucet 300 on a kitchen countertop are presented.

The freestanding dispenser 200 has a base 201, a trunk 202 and a holder 203. The base 201 is generally placed on a first countertop 204 to hold liquid soap, such as dish soap or hand soap, as well as other liquids such as veggie wash, hand lotion, hand sanitizer, etc.

The opening 116 of the countertop protective device 100 is placed around the base 201 of the freestanding dispenser 200. The first end 114 and the second end 115 are coupled together and securely coupled by the coupling of the magnets 180, 181.

In FIG. 2B, the faucet 300 has a base 301, a trunk 302 and a sprayer 303. The base 301 is generally coupled on a second countertop 304 substantially near a sink 400 to access water for washing dishes, hands, etc. Although, the faucet 300 is shown in a kitchen setting, it is hereby contemplated that the faucet 300 may be in any other type of setting, including, but not limited to, bathroom, workroom, laboratory, etc. and the description hereto will thereby be applicable.

The opening 116 of the countertop protective device 100 is placed around the base 301 of the faucet 300. The first end 114 and the second end 115 of the countertop protective device 100 are coupled together and securely coupled by the magnets 180, 181.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A countertop protective device to be used with a freestanding dispenser and for protecting a countertop from dripping, spraying and puddling of water, the device comprising:

an outer covering, the outer covering having an inside, a first end, a second end and an outside;

a plurality of magnets, a first of the magnets being coupled to the inside of the outer covering substantially near the first end of the outer covering, a second of the magnets being coupled to the inside of the outer covering substantially near the second end of the outer cover, wherein the first end of the outer covering and the second end of the outer covering being non-connected forming an opening; and an inner material, the inner material being coupled to the inside of the outer covering.

2. The device of claim 1, wherein the first of the magnets being a neodymium iron boron (NdFeB) magnet.

3. The device of claim 1, wherein the second of the magnets being a neodymium iron boron (NdFeB) magnet.

4. The device of claim 1, wherein the device being retractable.

5. The device of claim 1, wherein the device being extendable.

6. The device of claim 1, wherein the outer covering being made of a porous material.

7. The device of claim 6, wherein the porous material being a cloth material.

8. The device of claim 1, wherein the inner material being made of an absorbent material.

9. The device of claim 8, wherein the absorbent material being a sponge material.

10. The device of claim 1, wherein the freestanding dispenser is a freestanding hand soap dispenser.

11. The device of claim 1, wherein the freestanding dispenser is a freestanding veggie wash dispenser.

12. The device of claim 1, wherein the freestanding dispenser is a freestanding hand lotion dispenser.

13. The device of claim 1, wherein the freestanding dispenser is a freestanding dish soap dispenser.

14. The device of claim 1, wherein the freestanding dispenser is a freestanding hand sanitizer dispenser.

* * * * *